US008974204B2

(12) United States Patent
Park et al.

(10) Patent No.: US 8,974,204 B2
(45) Date of Patent: Mar. 10, 2015

(54) SCROLL COMPRESSOR

(75) Inventors: Junhong Park, Changwon (KR); Jangheon Choi, Changwon (KR); Gisub Roh, Changwon (KR); Honggyun Jin, Changwon (KR)

(73) Assignee: LG Electronics Inc., Seoul (KR)

( * ) Notice: Subject to any disclaimer, the term of this patent is extended or adjusted under 35 U.S.C. 154(b) by 64 days.

(21) Appl. No.: 13/606,065

(22) Filed: Sep. 7, 2012

(65) Prior Publication Data

US 2013/0064703 A1 Mar. 14, 2013

(30) Foreign Application Priority Data

Sep. 9, 2011 (KR) ..... 10-2011-0092208

(51) Int. Cl.
*F04C 27/00* (2006.01)
*F04C 18/02* (2006.01)
*F04C 23/00* (2006.01)

(52) U.S. Cl.
CPC ..... *F04C 18/0215* (2013.01); *F04C 23/008* (2013.01); *F04C 27/008* (2013.01); *F04C 2240/30* (2013.01)
USPC ..... 418/55.4; 418/55.1; 418/104; 418/125; 418/149

(58) Field of Classification Search
CPC .. F04C 18/02; F04C 18/0207; F04C 18/0215; F04C 18/0246; F04C 18/0253; F04C 23/008; F04C 27/008; F01C 1/02; F01C 1/0207; F01C 1/0215; F01C 1/0246; F01C 1/0253
USPC ..... 418/55.1–55.6, 57, 104, 125, 149
See application file for complete search history.

(56) References Cited

U.S. PATENT DOCUMENTS

| | | | | |
|---|---|---|---|---|
| 6,220,839 | B1 * | 4/2001 | Sheridan et al. | 418/55.1 |
| 7,044,719 | B2 * | 5/2006 | Yanagisawa et al. | 417/410.5 |
| 7,708,536 | B2 * | 5/2010 | Ginies et al. | 418/55.6 |
| 2004/0166007 | A1 * | 8/2004 | Schofield et al. | 418/55.1 |
| 2005/0232800 | A1 * | 10/2005 | Kammhoff et al. | 418/55.6 |
| 2007/0059192 | A1 * | 3/2007 | Stover | 418/55.1 |

(Continued)

FOREIGN PATENT DOCUMENTS

| | | | |
|---|---|---|---|
| CN | 101614205 | A | 12/2009 |
| JP | H5-026180 | A | 2/1993 |

(Continued)

OTHER PUBLICATIONS

Korean Office Action dated Dec. 12, 2012.

(Continued)

*Primary Examiner* — Thomas Denion
*Assistant Examiner* — Xiaoting Hu
(74) *Attorney, Agent, or Firm* — KED & Associates, LLP

(57) ABSTRACT

In a scroll compressor, a sealing portion of a discharge cover placed between a suction spacer and a discharge space is formed to be spaced apart in an axial direction from a fixed scroll, whereby the discharge cover is in contact with a fixture in an axial direction only on a single circumference, facilitating fabrication and assembling of the discharge cover. Also, after assembly, when the discharge cover is pressurized toward the fixed scroll by a discharge pressure of a refrigerant discharged to the discharge space, the discharge cover does not transfer pressurization force to the fixed scroll, thus reducing a frictional loss between the fixed scroll and an orbiting scroll.

12 Claims, 7 Drawing Sheets

(56) References Cited

U.S. PATENT DOCUMENTS

| | | | | |
|---|---|---|---|---|
| 2008/0138227 | A1* | 6/2008 | Knapke | 418/55.4 |
| 2009/0232670 | A1* | 9/2009 | Lai | 417/312 |
| 2010/0303661 | A1* | 12/2010 | Kimata et al. | 418/55.1 |

FOREIGN PATENT DOCUMENTS

| | | |
|---|---|---|
| JP | 5-172065 | 7/1993 |
| JP | 11-50981 | 2/1999 |
| JP | 2003-56478 | 2/2003 |
| KR | 10-0455424 | 9/2003 |

OTHER PUBLICATIONS

Korean Office Action dated Jun. 24, 2013.

Chinese Office Action dated Dec. 3, 2014, issued in Application No. 201210331379.5 (with English translation).

* cited by examiner

SCROLL COMPRESSOR

CROSS-REFERENCE TO RELATED APPLICATION

The present disclosure relates to subject matter contained in priority Korean Application No. 10-2011-0092208, filed on Sep. 9, 2011, which is herein expressly incorporated by reference in its entirety.

1 Field of the Invention

The present invention relates to a scroll compressor and, more particularly, to a low pressure scroll compressor in which an inner space of a container is divided into a suction space and a discharge space by a discharge cover.

2 Description of the Related Art

A scroll compressor is a compressor for compressing a refrigerant gas by changing the volume of a compression chamber formed by a pair of opposing scrolls. In comparison to a reciprocating compressor or a rotary compressor, a scroll compressor has high efficiency, low vibration and noise, and can be reduced in size and weight, and thus, such a scroll compressor is widely used, especially, in air-conditioners.

A scroll compressor may be divided into a low pressure scroll compressor and a high pressure compressor according to a pressure of a refrigerant filled in an inner space of the container thereof. In the low pressure scroll compressor, a suction pipe communicates with an inner space of the container and a refrigerant is indirectly sucked into a compression chamber through the inner space. Meanwhile, in the high pressure scroll compressor, a suction pipe directly communicates with a suction side of a compression unit and a refrigerant is directly sucked into the compression chamber, without passing through an inner space of the container.

FIG. 1 is a vertical sectional view of a related art low pressure scroll compressor. As illustrated, in the related art low pressure scroll compressor, an inner space of the container 10 is divided into a suction space S1 and a discharge space S2. The inner space of the container 10 is divided into the suction space S1 and the discharge space S2 by a main frame 20 or a fixed scroll 50, or may be divided into the suction space S1 and the discharge space S2 by a discharge plenum (not shown) fixed to an upper surface of the fixed scroll 50 or a discharge cover 80 as shown in FIG. 1

As shown in FIG. 2, the related art discharge cover 80 has an annular shape. An outer circumference side of the discharge cover 80 is airtightly coupled to the container 10, and an inner circumference side of the discharge cover 80 is fixedly coupled to an upper surface of the fixed scroll 50 to cover a discharge opening 53. The outer circumferential surface of the discharge cover 80 is bent and a support protrusion 81 having a band-like shape is formed on the outer circumferential surface. The support protrusion 81 is inserted between a shell 11 of the container 10 and an upper cap 12 and supported in an axial direction. A lower surface of the inner circumference of the discharge cover 80 is fixed to, tightly attached to and supported by an upper surface of the fixed scroll 50 in an axial direction in order to prevent a refrigerant discharged to the discharge space S2 from being leaked to the suction space S1. Reference numeral 13 denotes a lower cap, reference numeral 30 denotes a lower frame, reference numeral 40 denotes a driving motor, reference numeral 41 is a stator, reference numeral 42 denotes a rotor, reference numeral 43 denotes a crank shaft, reference numeral 51 denotes a fixed wrap, reference numeral 52 denotes a suction opening, reference numeral 60 denotes an orbiting scroll, reference numeral 61 denotes an orbiting wrap, reference numeral 70 denotes an oldhamring, reference letters SP denote a suction pipe, and reference letters DP denote a discharge pipe.

However, in the related art scroll compressor, both the outer circumference side and the inner circumference side of the discharge cover 80 are fixed in an axial direction, but since a discharged refrigerant pressurizes the inner circumferential side (i.e., region 'A' in FIG. 2), the fixed scroll 50 is pressed toward the orbiting scroll 60 by the pressurization force, increasing a frictional loss between the fixed scroll 50 and the orbiting scroll 60.

SUMMARY OF THE INVENTION

An aspect of the present invention provides a scroll compressor in which a discharge cover can be easily processed and assembled and a fixed scroll is prevented from being deformed toward an orbiting scroll by a pressurization force of a refrigerant discharged to a discharge space, thus reducing a frictional loss between the fixed scroll and the orbiting scroll.

According to an aspect of the present invention, there is provided a scroll compressor including: a container having an inner space; a fixed scroll installed in the inner space of the container; an orbiting scroll installed to be engaged with the fixed scroll to make a gyrational movement; and a discharge cover dividing an inner space of the container into a suction space and a discharge space, wherein a sealing portion is provided between the fixed scroll and the discharge cover in order to seal the suction space and the discharge space, and the sealing portion is formed such that the fixed scroll and the discharge cover are spaced apart from each other in an axial direction when the compressor is stopped.

According to another aspect of the present invention, there is provided a scroll compressor including: a shell having open upper and lower ends; an upper cap covering the upper end of the shell; a lower cap covering the lower end of the shell; a frame fixedly coupled to the shell; a fixed scroll supported by the frame and having a suction opening and a discharge opening; an orbiting scroll engaged with the fixed scroll to make a gyrational movement to form a continuously moving compression chamber; and a discharge cover dividing the suction opening and the discharge opening of the fixed scroll, wherein a annular first sealing portion is formed to be protruded in the vicinity of the discharge opening of the fixed scroll, and a second sealing portion is formed to be bent on the discharge cover and inserted into the first sealing portion.

According to another aspect of the present invention, there is provided a scroll compressor including: a container; a frame fixed in an inner space of the compressor container; a fixed scroll supported by the frame and having a suction opening and a discharge opening; an orbiting scroll engaged with the fixed scroll to make a gyrational movement to form a continuously moving compression chamber; and a discharge cover dividing the inner space of the container into a suction space communicating with the suction opening and a discharge space communicating with the discharge opening, wherein a sealing portion is formed on an inner circumference side of the discharge cover to separate the suction space and the discharge space, a support is formed on an outer circumference side of the discharge cover to support the discharge cover in an axial direction, and when the compressor is stopped, the sealing portion is spaced apart from the fixed scroll in an axial direction and the support portion comes in contact with the frame or the fixed scroll in the axial direction.

The foregoing and other objects, features, aspects and advantages of the present invention will become more apparent from the following detailed description of the present invention when taken in conjunction with the accompanying drawings.

DETAILED DESCRIPTION OF THE INVENTION

A scroll compressor according to an embodiment of the present invention will be described with reference to the accompanying drawings.

Figure 1:
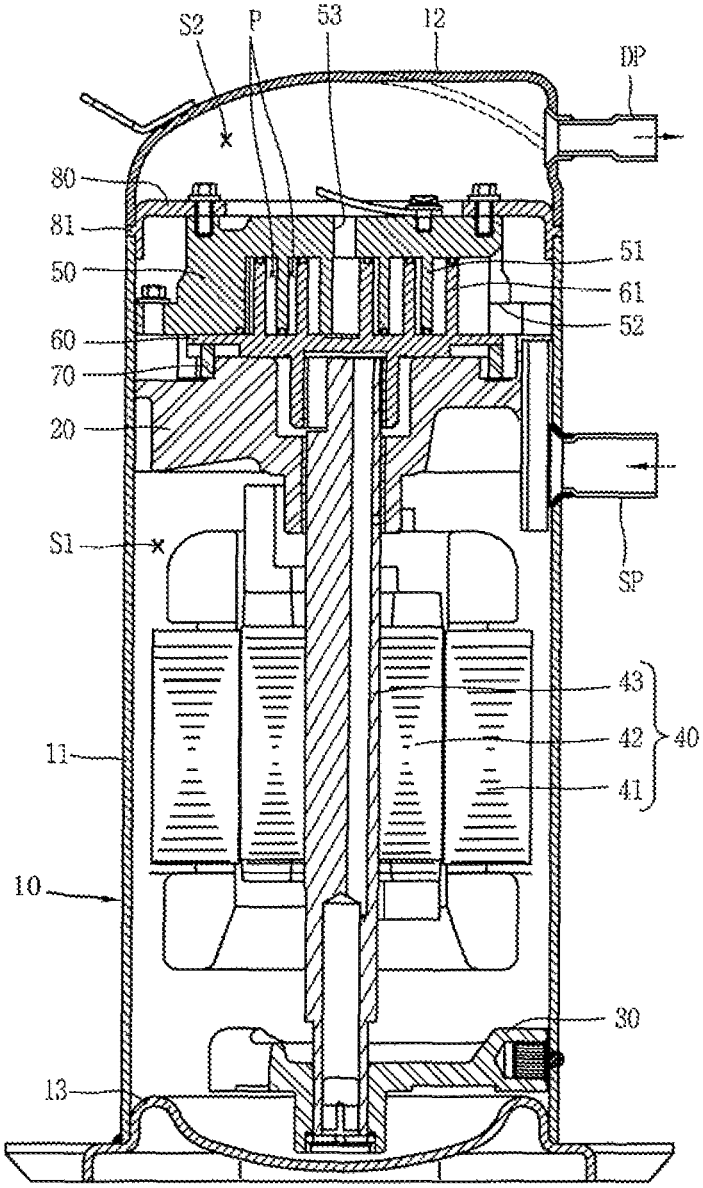
FIG. 1 CONVENTIONAL ART
FIG. 1 is a view showing an electromagnetic switching device according to an embodiment of the present invention.
Figure 2:
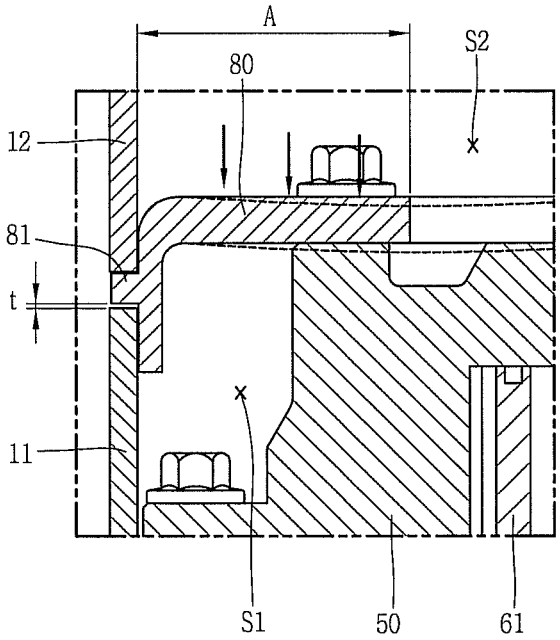
FIG. 2 CONVENTIONAL ART
FIG. 2 is an enlarged view illustrating a coupled state of a fixed scroll and a discharge cover in FIG. 1.
Figure 3:
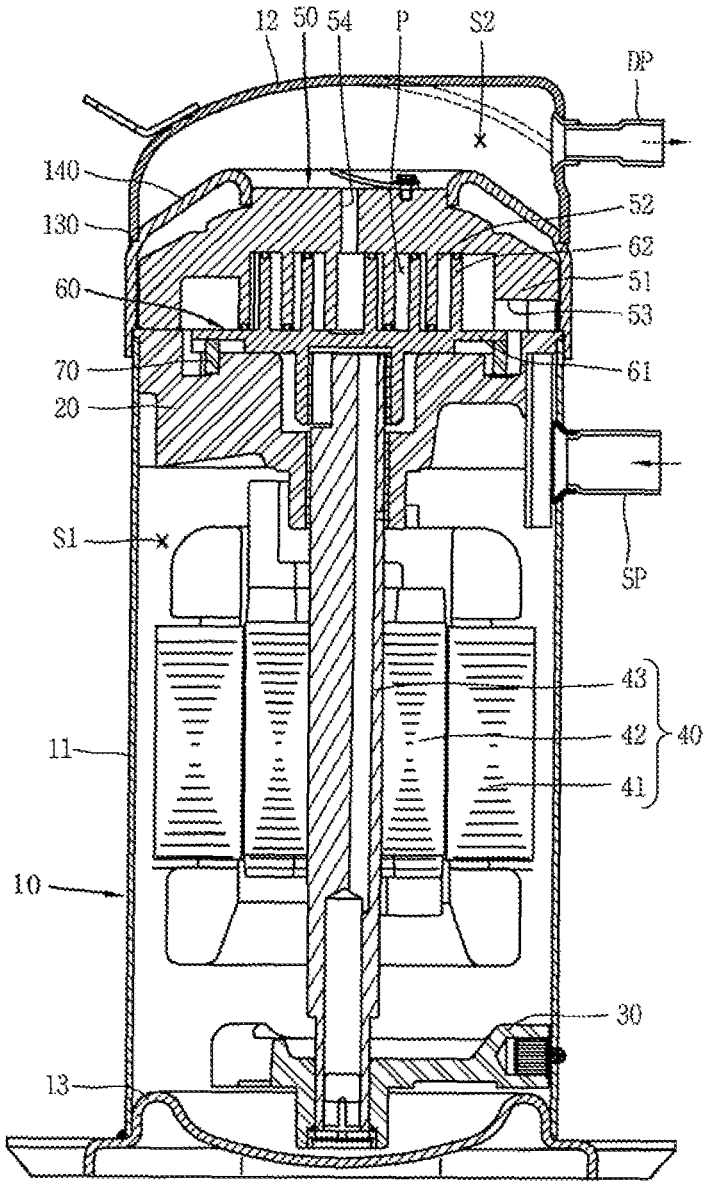
FIG. 3 is a vertical sectional view illustrating an example of a scroll compressor according to an embodiment of the present invention.

As illustrated in FIG. 3, in the scroll compressor according to an embodiment of the present invention, an inner space of a container 10 may be divided into a suction space S1 as a low pressure part and a discharge space S2 as a high pressure part. A driving motor 40 for generating a rotational force may be installed in the suction space S1 of the container 10. A main frame 20 may be fixedly installed between the suction space S1 and the discharge space S2 of the container 10. A subframe 30 may be installed on a lower end of the suction space S1.

The driving motor 40 may be installed between the main frame 20 and the subframe 30, and a fixed scroll 50 may be fixedly installed on an upper surface of the main frame 20.

An orbiting scroll 60 may be installed between the main frame 20 and the fixed scroll 50 such that it is gyrational. The orbiting scroll 60 may be eccentrically coupled to a crank shaft 43 of the driving motor 40 to form a pair of compression chambers P continuously moving together with the fixed scroll 50. An oldhamring 70 may be installed between the fixed scroll 50 and the orbiting scroll 60 in order to prevent the orbiting scroll 60 from being rotated.

The container 10 may include a cylindrical shell 11 and an upper cap 12 and a lower cap 13 covering an upper opening end of the shell 11 and a lower opening end of the shell 11.

A suction pipe SP may be coupled to communicate with the suction space S1 of the container 10, and a discharge pipe DP may be coupled to communicate with the discharge space S2.

Figure 4:
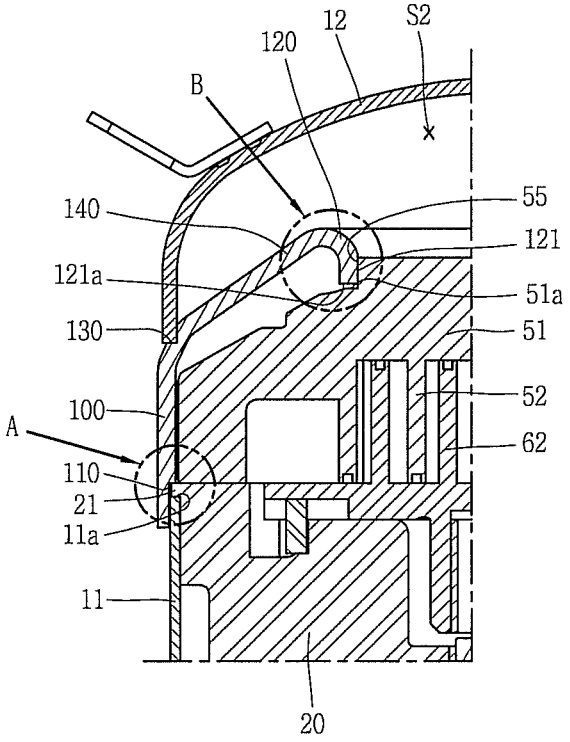
FIG. 4 is an enlarged view illustrating a coupled state of a fixed scroll and a discharge cover in FIG. 3.

The container 10 may have the hermetically sealed discharge space S2, and the suction space S1 as a low pressure part and the discharge space S2 as a high pressure part may be divided by a discharge plenum (not shown) fixedly coupled to the fixed scroll 50, or as shown in FIGS. 3 and 4, the inner space of the container 10 may be divided into the suction space S1 and the discharge space S2 by a discharge cover 100 tightly attached to an inner circumferential surface of the container 10.

Figure 6:
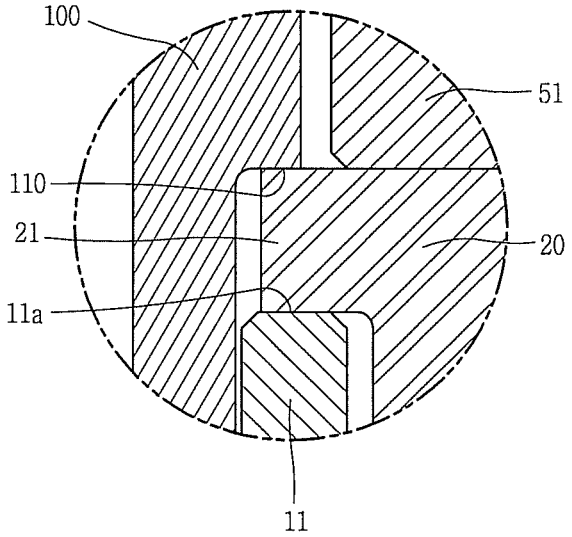
Figure 7:
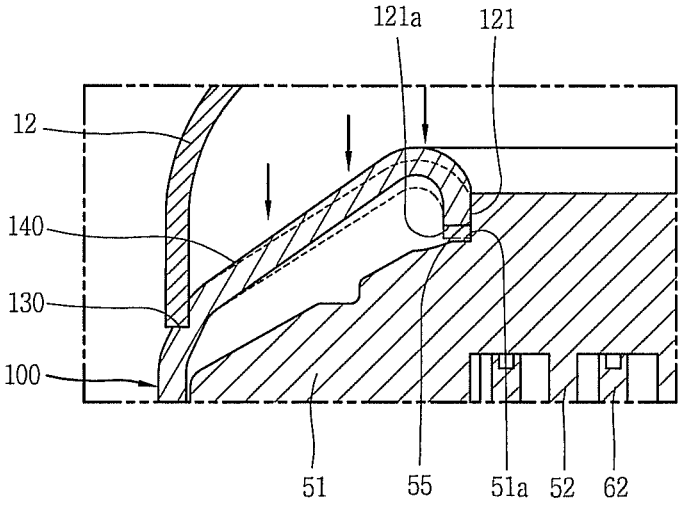
FIG. 7 is a cross-sectional view showing a state in which a discharge cover absorbs a pressurization force of a discharge gas in FIG. 4.

The entirety or a portion of an outer circumferential surface of the main frame 20 may be fixedly welded to an inner circumferential surface of the shell 11 of the container 10. However, as shown in FIG. 6, a support protrusion 21 having a band-like shape or a protuberance-like shape is formed on an outer circumferential surface of the main frame 20 and mounted on an upper opening end 11*a* of the shell 11 of the container 10 so as to be supported in an axial direction. When the outer circumferential surface of the main frame 20 is tightly attached to the inner circumferential surface of the shell 11 of the container 10, a communication hole (not shown) or a communication recess (not shown) allowing the suction space S1 and a suction opening 53 (to be described) to communicate with each other may be formed.

In the fixed scroll 50, a fixed wrap 52 may be formed to be protruded from a lower surface of a disk plate 51 to constitute a compression chamber P together with an orbiting wrap 62 of the orbiting scroll 60. In the fixed scroll 50, a suction opening 53 is formed on an outer circumferential surface of the disk plate 51 to allow the suction space S1 of the container 10 and the compression chamber P to communicate with each other. A discharge opening 54 may be formed at a central portion of the disk plate 51 of the fixed scroll 50 to allow the compression chamber P and the discharge space S2 of the container 10 to communicate with each other.

The disk plate 51 of the fixed scroll 50 may have an annular shape and fixedly coupled to an upper surface of the main frame 20. When the support protrusion 21 is not provided in the main frame 20, the same support protrusion (not shown) may be formed on an outer circumferential surface of the disk plate 51 of the fixed scroll 50.

The discharge cover 100 may be installed on an upper surface of the disk plate 51 of the fixed scroll 50 in order to separate the interval space of the container 10 into the suction space S1 and the discharge space S2.

The discharge cover 100 may be formed by pressurizing a plate body having a certain thickness. When viewed from a plane, the discharge cover 100 may have an annular shape. A support portion 110 is formed on the outer circumference side of the discharge cover 100, on which the support protrusion 21 of the main frame 20 or a support protrusion (not shown) of the fixed scroll 50 is mounted and supported in an axial direction. A sealing portion 120 may be formed on the inner circumferential side of the discharge cover 100 and is tightly attached to the disk plate 51 of the fixed scroll 50 in a radial direction to cover the vicinity of the discharge opening 54.

The support portion 110 may be formed as a step by bending the outer circumference side of the discharge cover 100, such that it is mounted on the support protrusion 21 of the main frame 20 or the support protrusion of the fixed scroll 50 on an inner circumferential surface of the discharge cover 100, Also, a fixing portion 130 may be formed as a step in the vicinity of an outer portion of the support portion 110 to allow the upper cap 12 to be fixedly mounted thereon.

Figure 5:
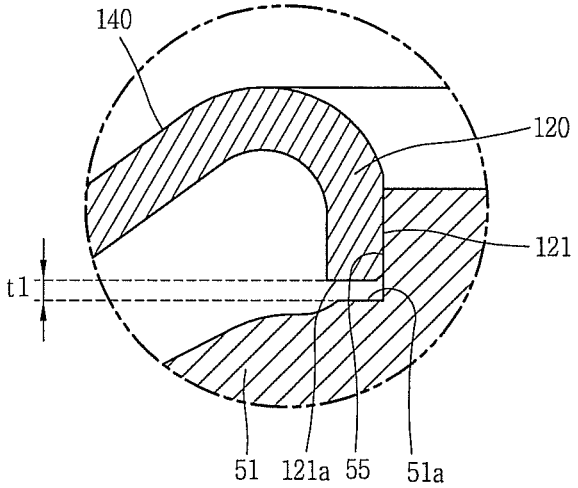
FIGS. 5 and 6 are enlarged views illustrating a portion 'A' and a portion 'B' in FIG. 4, respectively.

The sealing portion 120 may be formed by bending an inner circumference side of the discharge cover 100 toward the fixed scroll 50. To this end, as shown in FIG. 5, a first sealing portion 55 may be formed to have an annular shape and have a certain height on an upper surface of the disk plate 51 of the fixed scroll 50, namely, in the vicinity of the discharge opening 54, and a second sealing portion 121 may be formed to be inserted in the first sealing portion 55 and is in contact therewith in a radial direction in the inner circumference side of the discharge cover 100.

A lower end of the second sealing portion 121 may be formed to be spaced apart by a certain interval from the upper surface 51*a* of the disk plate 51 of the fixed scroll 50. Preferably, the second sealing portion 121 is formed to have a space t1 so that a lower end 121*a* of the second sealing portion 121 is not brought into contact with an upper surface 51*a* of the fixed scroll 50 or is not excessively tightly contact therewith although a high pressure refrigerant discharged to the discharge space S2 pressurizes the discharge cover 100.

However, although not shown, the second sealing portion 121 may have an annular shape and planar shape, rather than being bent, so an inner circumferential surface thereof may be substantially in contact with an outer circumferential surface of the first sealing portion 55. In this case, a lower surface of the vicinity (the second sealing portion 121) of the inner circumference side of the discharge cover 100 may be coupled such that it is spaced apart by a certain interval from the upper surface 51*a* of the fixed scroll 50.

Meanwhile, preferably, the discharge cover 100 may have a sloped surface portion 140 formed to be downwardly sloped toward a support portion 110 between the second sealing portion 121 and the support portion 110 to distribute a gas pressure. To this end, preferably, the fixed scroll 50 is formed to be sloped downwardly toward the outer circumference of the first sealing portion 55.

Reference numeral 41 denotes a stator and reference numeral 42 denotes a rotor.

The scroll compressor according to the present embodiment has the following operational effect.

Namely, when power is applied to the driving motor 40 to generate rotational force, the orbiting scroll 60 eccentrically coupled to the crank shaft 43 of the driving motor 40 makes a gyrational movement to form a pair of (or two) compression chambers P continuously moving between the orbiting scroll 60 and the fixed scroll 50. The compression chambers P are formed continuously in several stages such that a volume thereof is gradually reduced toward the discharge opening (or a discharge chamber) 54 from the suction opening (or the suction chamber) 53.

Then, the refrierant sucked from the outside of the container 10 is introduced into the suction space S1, a low pressure portion, of the container 10 through the suction pipe SP, and the low pressure refrigerant the suction space S1 is introduced through the suction opening 53 of the fixed scroll 50 and move in a direction of a final compression chamber by the orbiting scroll 60 so as to be compressed, and then, discharged to the discharge space S2 of the container 10 through the discharge opening 54 of the fixed scroll 50 from the final compression chamber. This sequential process is repeatedly performed.

Here, since the discharge space S2 is separated from the suction space S1 by the sealing portion 120 of the discharge cover 100, the refrigerant discharged to the discharge space S2 moves to a refrigerating cycle through the discharge pipe DP, rather than flowing backward to the suction space S1.

Here, when the sealing portion (namely, the second sealing portion) 121 of the discharge cover 100 is tightly attached to the upper surface 51*a* of the fixed scroll 50 in the axial direction, the fixed scroll 50 may be pressurized toward the orbiting scroll 60 by the high pressure refrigerant discharged to the discharge space S2 so as to be deformed, resulting in that a frictional loss is increased between the fixed scroll 50 and the orbiting scroll 60 to degrade performance of the compressor.

However, in the present embodiment, since the second sealing portion 121 of the discharge cover 100 is in contact with the first sealing portion 55 of the fixed scroll 50 only in the radial direction and coupled to maintain a certain space in the axial direction, although the discharge cover 100 is pressed by the discharged refrigerant, the sealing portion 120 of the discharge cover 100 does not pressurize the fixed scroll in the axial direction. Thus, the fixed scroll 50 and the orbiting scroll 60 are prevented from being excessively tightly attached to each other, thus preventing a degradation of efficiency of the compressor due to an increase in the frictional loss.

Figure 8:
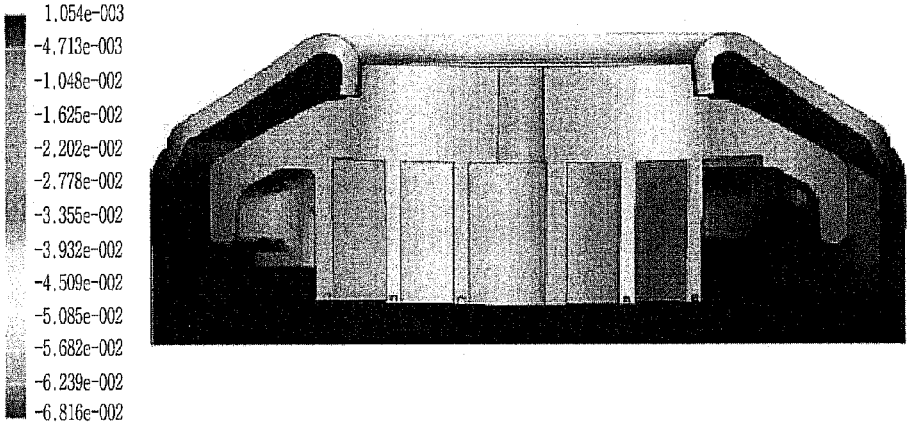
FIGS. 8 and 9 are views illustrating the results of experimentation showing a comparison between a deformation degree of the fixed scroll when the sealing portion of the discharge cover has an overlap section with the fixed scroll in an axial direction (FIG. 8) and when the sealing portion does not have an overlap section (FIG. 9) according to an embodiment of the present invention.
Figure 9:
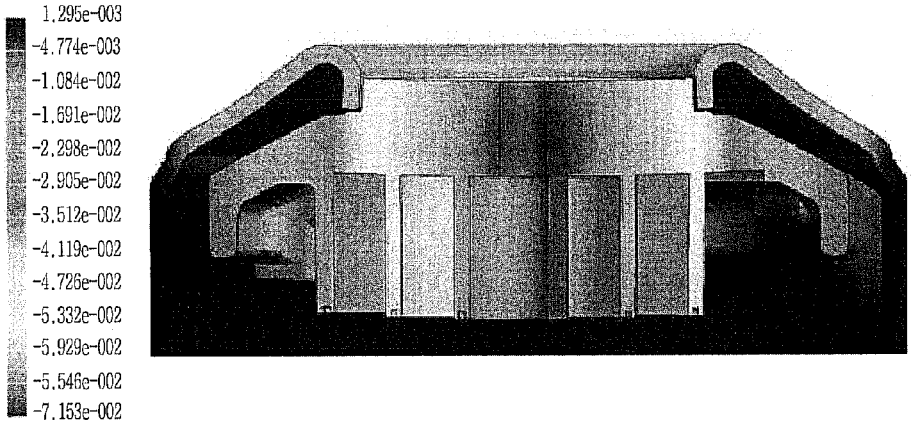

FIGS. 8 and 9 are views illustrating the results of experimentation showing a comparison between a deformation degree of the fixed scroll when the sealing portion of the discharge cover has an overlap section with the fixed scroll in an axial direction (FIG. 8) and when the sealing portion does not have an overlap section (FIG. 9) according to an embodiment of the present invention.

As illustrated, it can be seen that, when the discharge cover 100 and the fixed scroll 50 have an overlap section in the axial direction, a central portion of the fixed scroll 50 is severely loaded. However, when the discharge cover 100 and the fixed scroll 50 do not have an overlap section in the axial direction, the central portion of the fixed scroll 50 is relatively less loaded. Thus, it can be seen that when the sealing portion 120 of the discharge cover 100 is coupled to the fixed scroll 50 such that it does not overlap in the axial direction, the fixed scroll 50 is prevented from being deformed.

Meanwhile, when the second sealing portion 121 of the discharge cover 100 is not supported by the first sealing portion 55 of the fixed scroll 50 and only the support portion 110 of the discharge cover 100 is supported by the fixed scroll 50, the main frame 20, or the shell 11 of the container 10, since only one point is supported in the axial direction, processing and assembling of the discharge cover 100 can be facilitated. Namely, when even the second sealing portion 121, as well as the support portion 110 of the discharge cover 100 is in contact with the fixed scroll 50, or the like, in the axial direction, since two points are supported, the discharge cover 100 should be more precisely processed and assembled. Thus, in the present embodiment, when only the support portion of the discharge cover is supported in the fixed scroll or the main frame in the axial direction while the sealing portion of the discharge cover is spaced art from the fixed scroll, processing or assembling process of the discharge coves: and the fixed scroll can be facilitated.

As the present invention may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A scroll compressor, comprising:

a container having an inner space;

a fixed scroll installed in the inner space of the container;

an orbiting scroll installed to be engaged with the fixed scroll to make a gyrational movement; and a discharge cover that divides the inner space of the container into a suction space and a discharge space, wherein the discharge cover includes:

a sealing portion provided on a portion of the discharge cover that faces the fixed scroll, wherein the sealing portion is configured such that an upper surface of the fixed scroll and an end surface of the sealing portion are spaced apart from each other in an axial direction of the scroll compressor when the scroll compressor is stopped and is configured to seal the suction space from the discharge space;

a support portion formed as a step on an inner circumferential surface of the discharge cover and supported on a main frame; and a fixing portion formed on an outer circumferential surface of the discharge cover and configured to support the container.

2. The scroll compressor of claim 1, wherein a first sealing portion is formed on the fixed scroll to protrude toward the discharge space, wherein the sealing portion of the discharge cover comprises a second sealing portion into which the first sealing portion is inserted so as to be slidably in contact in a radial direction, and wherein an end surface of the second sealing portion is spaced apart in the axial direction from the upper surface of the fixed scroll when the scroll compressor is stopped.

3. The scroll compressor of claim 2, wherein the second sealing portion is formed to be bent toward the fixed scroll.

4. The scroll compressor of claim 1, wherein the discharge cover further comprises a sloped surface portion formed between the sealing portion and the support portion and wherein the sloped surface portion is formed to be downwardly sloped toward the support portion.

5. The scroll compressor of claim 1, wherein the container includes a cylindrical shell having an upper open end and a lower open end, an upper cap supported on the fixing portion of the discharge cover, and a lower cap that covers the lower open end of the cylindrical shell.

6. The scroll compressor of claim 5, wherein the main frame includes a support protrusion formed on an outer circumferential surface of the main frame that protrudes in a radial direction and is supported on the upper open end of the cylindrical shell.

7. The scroll compressor of claim 1, wherein the main frame is fixedly installed in the container between the discharge space and the suction space, and wherein the fixed scroll is fixedly installed on an upper surface of the main frame.

8. A scroll compressor, comprising:

a shell having open upper and lower ends;

an upper cap that covers the upper end of the shell;

a lower cap that covers the lower end of the shell;

a frame fixedly coupled to the shell;

a fixed scroll supported by the frame and having a suction opening and a discharge opening;

an orbiting scroll engaged with the fixed scroll to make a gyrational movement to form a continuously moving compression chamber; and a discharge cover that divides the suction opening from the discharge opening of the fixed scroll, wherein an annular first sealing portion protrudes around the discharge opening of the fixed scroll, wherein a second sealing portion is formed to be bent on the discharge cover and inserted onto the first sealing portion, wherein the second sealing portion is formed such that an end surface of the second sealing portion is spaced apart from an upper surface of the fixed scroll in an axial direction of the scroll compressor when the scroll compressor is stopped, wherein a support protrusion is formed on an outer circumferential surface of the frame to protrude in a radial direction and is supported on a top of the shell wherein a support portion is formed as a step on an inner circumferential surface of the discharge cover, the support portion being supported on the support portrusion of the frame in the axial direction, and wherein a fixing portion is formed to be bent or stepped on an outer circumferential surface of the discharge cover, wherein the fixing portion supports the upper cap in the axial direction.

9. The scroll compressor of claim 8, wherein the discharge cover includes a sloped surface portion formed to be sloped downwardly toward the support portion from the second sealing portion.

10. A scroll compressor, comprising:

a container;

a frame fixed in an inner space of the container;

a fixed scroll supported by the frame and having a suction opening and a discharge opening;

an orbiting scroll engaged with the fixed scroll to make a gyrational movement to form a continuously moving compression chamber; and a discharge cover that divides inner space of the container into a suction space that communicates with the suction opening and a discharge space that communicates with the discharge opening, wherein a sealing portion is formed on an inner circumference side of the discharge cover that separates the suction space and the discharge space, wherein a support portion is formed on an inner circumference side of the discharge cover to support the discharge cover in an axial direction of the scroll compressor, wherein a fixing portion is formed on an outer circumferential surface of the discharge cover to support the container, and wherein when the scroll compressor is stopped, an end surface of the sealing portion is spaced apart from an upper surface of the fixed scroll in the axial direction and the support portion comes in contact only with the frame in the axial direction.

11. The scroll compressor of claim 10, wherein an annular first sealing portion protrudes around the discharge opening of the fixed scroll, and wherein a second sealing portion is formed to be bent on an inner circumferential surface of the discharge cover, and wherein the second sealing portion is coupled to an outer circumferential surface of the first sealing portion.

12. The scroll compressor of claim 11, wherein a sloped surface portion is formed to be downwardly sloped toward the support portion between the sealing portion and the support portion.

* * * * *